US005092783A

United States Patent [19]

Suarez et al.

[11] Patent Number: 5,092,783

[45] Date of Patent: Mar. 3, 1992

[54] RF INTERCONNECT

[75] Inventors: Jose I. Suarez, Coral Gables; William J. Martin; James V. Lauder, both of Fort Lauderdale; Harold M. Cook, Sunrise, all of Fla.

[73] Assignee: Motorola, Inc., Schaumburg, Ill.

[21] Appl. No.: 700,829

[22] Filed: May 16, 1991

[51] Int. Cl.[5] ..... H01R 9/09

[52] U.S. Cl. ..... 439/71; 439/66; 439/81; 439/862; 439/876; 439/885

[58] Field of Search ..... 439/66, 71, 80, 81, 439/83, 862, 876, 885

[56] References Cited

U.S. PATENT DOCUMENTS

| | | | |
|---|---|---|---|
| 3,996,603 | 12/1976 | Smith | 357/80 |
| 4,354,729 | 10/1982 | Grabbe et al. | 339/17 CF |
| 4,504,887 | 3/1985 | Bakermans et al. | 439/71 |
| 4,511,201 | 4/1985 | Baker et al. | 439/71 |
| 4,642,889 | 2/1987 | Grabbe | 339/275 B |
| 4,699,593 | 10/1987 | Grabbe et al. | 439/71 |
| 4,904,213 | 2/1990 | Hock et al. | 439/824 |
| 4,906,194 | 3/1990 | Grabbe | 439/71 |
| 4,927,369 | 5/1990 | Grabbe et al. | 439/82 |
| 4,969,826 | 11/1990 | Grabbe | 439/66 |

OTHER PUBLICATIONS

Servometer-"Gold Plated Bellows Contact Springs" Sales Brochure.

*Primary Examiner*—Paula A. Bradley
*Attorney, Agent, or Firm*—Juliana Agon

[57] ABSTRACT

An RF contact (2) provides multiple RF paths (51-53) with minimal RF path lengths between a first (8) and second (36) interconnecting surfaces. A stationary member (6) is soldered on the first surface (8). A main spring member (22) is resiliently (26) connected to the stationary member (6) on a springing end (27) to provide contact travel (38) which ensures wiping action with the second surface (36). A secondary spring member (28) having at least two wiping portions (42 and 46) is resiliently (29) connected to the displacement member on its other end (38) to engage the stationary member (6) and the main spring member (22) along the at least two wiping portions (42 and 46) when the main spring member (22) is resiliently biased against the secondary spring member (28) and the stationary member (6).

10 Claims, 2 Drawing Sheets

RF INTERCONNECT

TECHNICAL FIELD

This invention relates generally to electrical connectors and more particularly to radio frequency (RF) interconnects, contacts, or connectors which can be produced in extremely small sizes and exhibit low self-inductances.

BACKGROUND

As communication devices such as portable two-way radios and paging receivers become smaller, the components contained within the devices (i.e. an antenna's RF contact or a power amplifier module, etc.) will tend to be smaller also. For example, the power amplifier may be integrated as an integrated circuit (IC) that is commonly packaged in an IC chip carrier, having very many small contact pads. If flexibility is desired in inserting, removing, and reinserting these components, for testing purposes or actual usage in the communication device, there is a need to connect these components without permanently soldering them on to a printed circuit board (PCB).

Therefore, these certain parts or components such as diodes, power amplifiers, antennas, engaging boards or printed circuitry or printed circuit boards (PCBs) require one or more spring contacts to achieve reliable electrical connection. Spring features provide the flexibility to avoid tolerances build up when manufacturing dimensions are not all perfectly exact. This tolerance problem comes into effect especially when extremely close facing of terminals or contact pads are required. The compliance is also needed to accommodate departures from planarity as is common in high volume manufacturing processes where the contact pads may not be exactly flat.

Accordingly, a compliant, a flexible, or a spring type of contact, terminal, or connector is becoming increasingly attractive for small components. The convention method of electrically connecting such pads of an electronic component being of a miniature size, is to interpose between the electronic component and the printed circuit board, an electrical connector such as a type of conductive elastomer, a pogo pin, a bellows-spring contact or a "fuzz button".

The conductive elastomer is self-explanatory, since it is a type of elastomer that is made conductive by molding plated wires through out the body of the elastomer, and extending these wires to the contact surfaces. The "fuzz button" or "fuzz ball" is a resilient mesh of fine gold or gold-plated wires in a cylinder. However, the "fuzz buttons" or balls are expensive to provide in view of the amount of gold that must be used and their construction is labor intensive.

The pogo pin is an elongated pin containing a head which makes contact with one surface and can be compressed by its connection to a spring within a socket of the pin that is soldered to the printed circuit board. These pogo pins are expensive and a certain amount of height is necessary for the elongated pogo pin. In fact, the length of the compressed pogo pin creates an amount of self-inductance that cannot be minimized to achieve a minimum RF path.

The gold plated miniature metal bellows is like an accordion spring that is also elongated as is the pogo pin. Similarly, its height presupposes a certain threshold of self-inductance.

Another deficiency of the prior art is that conductive elastomers, bellows, pogo pins, "fuzz buttons" and other conventional connectors have no capability of wiping the contact pads that they are to connect upon their engagement of those pads. Thus, they do not provide self-cleaning action. After a moderate number of components are changed or replaced, debris will build up and degrade radio frequency (RF) performance over time if the debris is not cleaned, and the contact must be eventually replaced.

There are other compliant designs which provide one or more spring arms of a contact for flexibility and another portion of the contact provides a short low inductance current path for the current. However, this low inductance path is still not short enough at high frequencies such as radio frequency (RF) or microwave frequency. Additionally, these prior art designs purposely provided for only a single circuit path through the terminal. However, it is to be appreciated that parallel inductance paths will reduce the total inductance even though multiple paths are difficult to implement. The minimum self-inductance requirement was not so stringent for these prior art designs, since they were mainly used for digital switching times in the nanoseconds range. However, as the switching times approach the pico-second range, relating to microwave frequencies and above, the RF path will need to be much shorter.

SUMMARY OF THE INVENTION

Briefly, according to the invention, an RF contact provides multiple RF paths with minimal RF path lengths between a first and second interconnecting surfaces. A stationary member is soldered on a first surface. A main spring member is resiliently connected to the stationary member on a first end to provide contact travel which ensures wiping action with the second surface. A secondary spring member having at least first and second opposed wiping contacts is resiliently connected to the main spring member on its other end to engage the stationary member and the main spring member along the at least two spring portions when the main spring member is resiliently biased against the secondary spring member and the stationary member.

DETAILED DESCRIPTION OF THE PREFERRED EMBODIMENT

Figure 1:
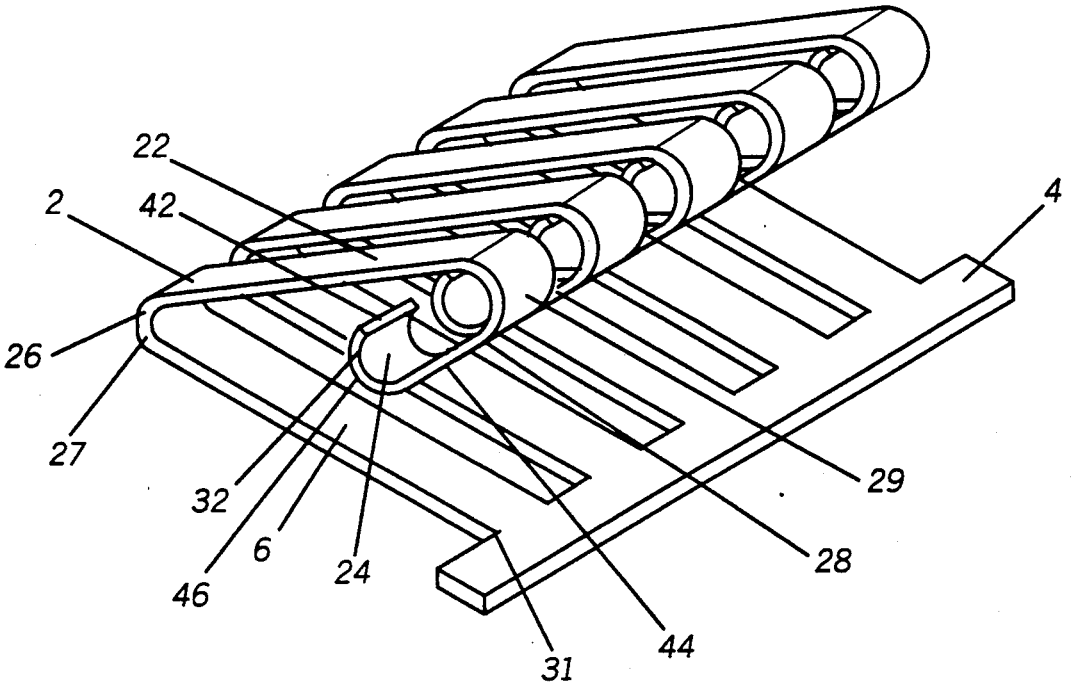
FIG. 1 is a perspective view of multiple RF interconnects in accordance with the invention.

Referring to FIG. 1, a single RF interconnect 2 in the form of a "V" shaped spring member includes a main spring member or leg 22, having a tilted secondary spring member 24, a stationary member, or a first leg 6, and a first joining portion 26 resiliently connecting the main spring member 22 with the stationary member or a second leg 6, at a first end 27 while an alignment bar 4 connects the stationary member 6 at the second end 31. It is to be appreciated that the parts of the interconnect 2 can be integrally connected.

The tilted portion or secondary spring member 24 includes a second joining portion 29, a "J" shaped spring 28 formed by an extension 44 and spring form 32. The extention 44 is connected to the second leg 22 on a second end by the second joining portion 29. As can be implemented in various ways, the "J" spring 28 includes at least a serially connected spring form 32. Each of the spring form 32 includes a first and second opposed wiping contacts 46 and 42.

The first joining portion 26 is formed to provide the main spring member 22 resiliently bendable towards the stationary member 6. Likewise, the second joining portion 29 is formed to provide the tilted secondary spring member 24 resiliently bendable towards the main spring member 22. In other words, joining portions serve as spring forms to position the RF interconnect 2, from the unbiased relaxed position of FIG. 2, to the compressed or loaded position of FIG. 3. The RF interconnect 2 is gold plated to provide an oxide free surface which will not deteriorate over time and also provides optimum electrical performance at high frequencies.

Figure 2:
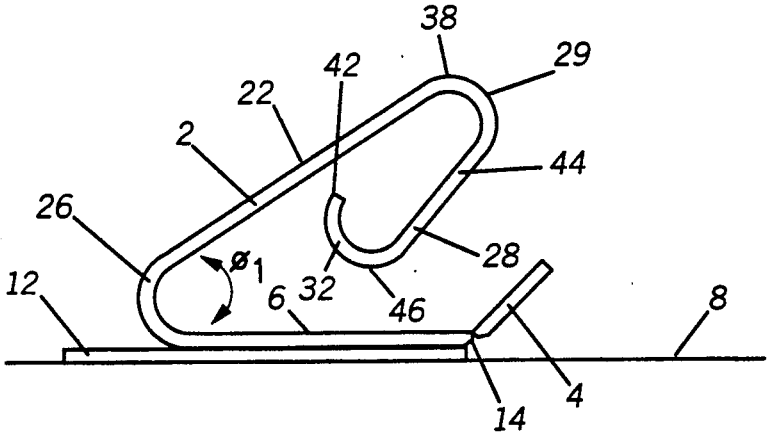
FIG. 2 is a side view showing the RF interconnect of FIG. 1 in a relaxed state.

As shown in FIG. 1, a plurality of RF interconnects 2 are retained by an integral lead frame 4. As part of the interconnect manufacturing design, the RF interconnects 2 are scored to form a notch 14 (visible only in FIG. 2). This lead frame 4 is a snap-off alignment bar, which is removed after the RF interconnect or contacts 2 are soldered to a first surface, such as a printed circuit board 8 along a soldered contact pad 12 as seen in FIG. 2. The snap-off alignment bar 4 assures proper alignment of the contact pads 12 of the printed circuit board 8 with the RF interconnect 2. After alignment, the alignment bar 4 is then bent at the notch 14 to snap off the lead frame at the notch 14 after the leads 6 have been soldered.

Figure 3:
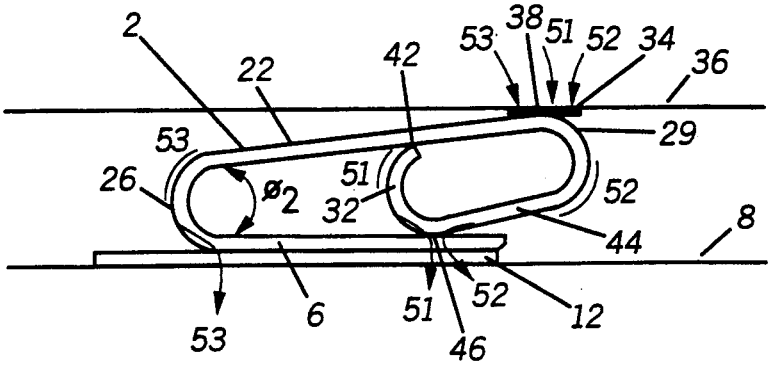
FIG. 3 is a side view similar to FIG. 2 but showing the position of the RF interconnect when the RF interconnect is in a compressed or loaded state.

Referring to FIG. 3, the RF interconnect 2 serves to provide conducting paths 51–53 between the terminal pads 34 on the underside of a second surface 36 such as a substrate for a chip carrier or other contact pads for a component to be used in a radio such as an antenna, and the terminal or soldered pads 12 which are on the upper side of the first surface 8. At the second end, an outwardly facing surface 38 of the intersection between the main spring member 2 and the second joining portion 28 serves as a main wiping contact 38 to engage with the contact pad 34.

After the RF interconnect 2 is secured to the first surface, or printed circuit board 8 by means of solder on the contact pad 12 and the second surface 36 is secured by conventional means to be pressed down on top of the RF interconnect 2, the contact pad 34 is biased against the main wiping contact 38, thereby forcing the main spring member 22, resiliently towards the stationary member 6. As the main spring member 22 of the RF interconnect 2 is pressed down, the angle $\phi$ formed between the main spring member 22 and the stationary member 6, changes (decreases from $\phi_1$ to $\phi_2$) as a function of contact pressure. This change in angle $\phi$ provides the "wiping", action of the contact by lateral movement of the main wiping contact 38. Any slight contaminate ion or debris that may be on the engaging surfaces of the contact pads 34 will accordingly be disrupted so that excellent electrical contact is repeatedly achieved between the pad 34 and the main wiping 38.

Additionally, as the main spring member 22 is moved towards the soldered stationary member 6, the second opposed wiping contact 42 of the spring form 32 engages and also wipes the bottom surface of the stationary member 22. Likewise, the intersection between the spring form 32 and the straight extension 44 forms the first opposed wiping contact 46 to perform similar wiping action against the top surface of the stationary member 6.

Since an extremely short electrical path is desirable for high speed (high frequency) devices in order to avoid inductance effects, a parallel inductance scheme provides a resultant smaller electrical path than a single short electrical path. Multiple, short RF paths are thus formed by the contacting surfaces via the RF interconnect 2 of the present invention. Firstly, the shortest path 51 is from the contact pad 34, at the main wiping contact 38, through the upper portion of the main spring member 22 contacting the second opposed wiping contact 42, through the spring form 32, the first opposed wiping contact 46 and finally to the contact pad 12 of the first contacting surface 8 via the soldered stationary member 6.

A second RF path 52, about the same length as the first path 51 and still considerably short, also starts from the contact pad 34 at the main wiping contact 38, via the second joining portion 29, through the straight extension 44 to the first opposed wiping contact 46, and again to the soldered contact pad 12 via the soldered stationary member 6. Thirdly, the longest but still substantially short RF path 53, likewise starts from the contact pad 34 at the main wiping contact 38 via the main spring member 22, through the first joining portion 26 and into the contact pad 12.

Figure 4:
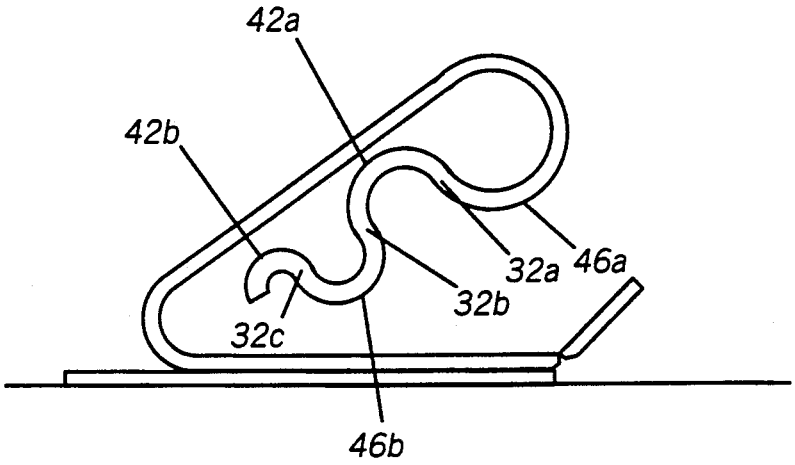
FIG. 4 is a side view of a second embodiment of the present invention in a relaxed state.
Figure 5:
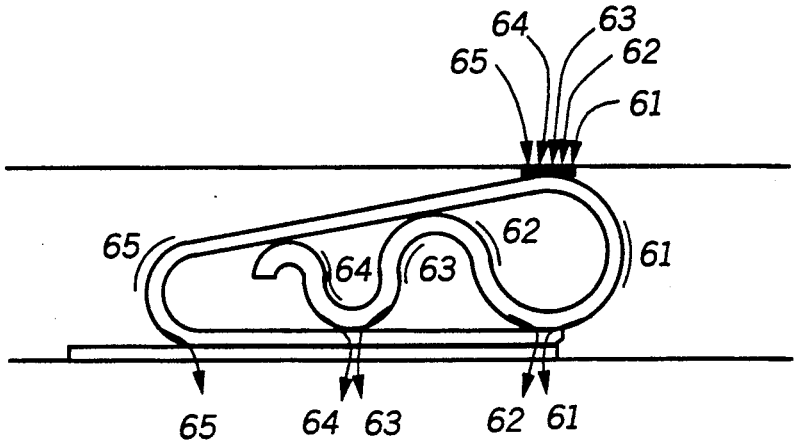
FIG. 5 is a side view similar to FIG. 4, but showing the second embodiment of the present invention in a compressed or loaded state.

Referring to FIGS. 4 and 5, the relaxed and compressed or loaded states of a second embodiment of the present invention are shown. The multiple curves or multiple additional spring forms 32*a–c* of the second embodiment provides five short RF paths 61 through 65 via the opposed wiping contacts 42*a–b* and 46*a–b*. It is to be appreciated that a wide variety of RF interconnect designs can be produced in accordance with the principles of the present invention to connect interconnecting surfaces with multiple short RF paths.

In summary, the parallel contact arrangement of the "V" shaped compressible spring allows the RF interconnect to make contact with two interconnecting surfaces upon compression to reduce the RF path links through multiple RF paths to provide a low inductance contact scheme. At the same time, the wiping contacts of the interconnect provides contact wiping action, which maintains contact integrity and RF performance over time.

What is claimed is:

1. An RF contact providing multiple RF paths with minimal RF path lengths between first and second interconnecting surfaces, comprising:

a stationary member soldered on said first surface;

a main spring member resiliently connected to said stationary member on a first end of said contact to provide contact travel which ensures wiping action with said second surface; and a secondary spring member having at least first and second opposed wiping contacts and resiliently connected to said main spring member on its second end to engage in between said stationary member and said main spring member along said at least first and second opposed wiping contacts when said main spring member is resiliently biased, by said second surface, against said secondary spring member and said stationary member to providing parallel current paths sufficiently short that at least a first RF current path flows through said first and second opposed wiping contacts, and a second RF current path flows through said second end and said first opposed wiping contact.

2. The RF interconnect of claim 1 wherein said members are integrally connected and are gold-plated.

3. The RF interconnect of claim 1 wherein said stationary member comprises a first leg portion.

4. The RF interconnect of claim 3 wherein said main spring member comprises a second leg portion.

5. The RF interconnect of claim 4 further comprising a first joining portion integrally joining said first and second leg portions.

6. The RF interconnect of claim 5 wherein said secondary spring member is tilted downwards and is connected by a second joining portion at a second end, said secondary spring member being resiliently bendable towards said main spring member.

7. An RF contact providing multiple RF paths with minimal RF path lengths between a first and a second interconnecting surfaces, comprising:

a stationary member soldered on said first surface, wherein said stationary member comprises a first leg;

a main spring member, resiliently connected to said stationary member on a first end of said contact, to provide contact travel which ensures wiping action with said second surface, wherein said main spring member comprises a second leg; and a secondary spring member having at least two spring portions and resiliently connected to said main spring member on its second end, to engage said stationary member and said main spring member, along said at least two spring portions when said main spring member is resiliently biased, by said second surface, against said secondary spring member and said stationary member, wherein said at least two spring portions comprise at least first and second opposed wiping contacts resiliently engagable in between said first and second legs for biasing said second wiping contact against said second leg and said first wiping contact against said first leg, and said second leg removably contacting said second surface.

8. An RF contact providing multiple RF paths with minimal RF path lengths between a first and a second interconnecting surfaces, comprising:

a stationary member soldered on said first surface, wherein said stationary member comprises a first leg;

a main spring member, resiliently connected to said stationary member on a first end of said contact, to provide contact travel which ensures wiping action with said second surface, wherein said main spring member comprises a second leg;

a first joining portion integrally joining said first and second legs; and a secondary spring member having at least two opposed wiping contacts and resiliently connected to said main spring member on its second end, to engage said stationary member and said main spring member, along said at least two opposed wiping contacts when said main spring member is resiliently biased, by said second surface, against said secondary spring member and said stationary member, wherein said secondary spring member is tilted downwards and is connected by a second joining portion at said second end, said secondary spring member being resiliently bendable towards said main spring member, wherein said first joining portion allows said main spring member to be resiliently bendable towards said stationary member to provide at least a first RF current path through said second joining portion and a second RF current path through said two opposed wiping contacts when said secondary spring member engages said main spring and stationary members.

9. The RF interconnect of claim 8 wherein said opposed two wiping contacts are resiliently engagable in between said first and second legs for biasing one of said opposed wiping contacts against said second leg and said other of said opposed wiping contacts against said first leg, and said second leg removably contacts said second surface.

10. An RF contact for a radio, comprising:

a "V" shaped compressible spring member having first and second legs, and a first joining portion on a first end;

a second joining portion on a second end; and a spring member including an extension, said spring member resiliently connected to said second leg on said second end by said second joining portion, said spring member including at least one serially connected spring form, each spring form including first and second opposed wiping contacts; said first opposed wiping contact connected to said extension;

said first leg soldered on an outer surface of said first leg to a first surface of said radio, said second leg having a main contact wiping portion at an outer surface of said second leg, approximately at said second end, to effect electrical engagement with a second surface of said radio, whereby as said second leg is resiliently depressed by said second surface towards said first surface, causing said second opposed wiping contact to engage an inner surface of said second leg and said first opposed wiping contact to engage an inner surface of said first leg, this motion results in a wiping action between said main contact wiping portion and said second surface, resulting in a first current flowing in a first path from said second surface through said main contact portion, said second leg, said first and second opposed wiping contacts, said extension, said first leg, and to said first device, a second current flowing in a second path from said second surface through said main contact portion, said second joining portion, said spring member, said first opposed wiping contact, said first leg, and to said first device, and at least a third current flowing in a third path from said second surface through said main contact portion, said second leg, said first joining portion, said first leg, and to said first surface.

* * * * *